United States Patent [19]

O'Brien

[11] Patent Number: 5,010,368

[45] Date of Patent: Apr. 23, 1991

[54] MAGNETIC TRANSPORT ROLL FOR SUPPLYING TONER OR CARRIER AND TONER TO A DONOR AND MAGNETIC DEVELOPER ROLL RESPECTIVELY

[75] Inventor: John F. O'Brien, Penfield, N.Y.

[73] Assignee: Xerox Corporation, Stamford, Conn.

[21] Appl. No.: 482,110

[22] Filed: Feb. 20, 1990

[51] Int. Cl.[5] ..... G03G 15/06

[52] U.S. Cl. ..... 355/259; 118/651; 118/654; 355/247; 355/253

[58] Field of Search ..... 355/245, 247, 251, 259, 355/246, 253; 118/653, 654, 651, 656, 657, 658

[56] References Cited

U.S. PATENT DOCUMENTS

| | | | |
|---|---|---|---|
| 4,008,686 | 2/1977 | Katakura et al. | 118/651 |
| 4,266,868 | 5/1981 | Bresina et al. | 355/3 DD |
| 4,383,497 | 5/1983 | Tajima | 118/651 |
| 4,384,545 | 5/1983 | Burnham et al. | 118/651 |
| 4,436,055 | 3/1984 | Yamashita et al. | 118/658 |
| 4,466,728 | 8/1984 | Schlageter et al. | 355/3 DD |
| 4,545,669 | 10/1985 | Hays et al. | 355/3 R |
| 4,565,437 | 1/1986 | Lubinsky | 355/3 DD |
| 4,572,647 | 2/1986 | Bean et al. | 355/3 R |
| 4,833,504 | 5/1989 | Parker et al. | 355/326 |
| 4,847,655 | 7/1989 | Parker et al. | 355/210 |
| 4,913,348 | 4/1990 | Hays | 355/246 X |

FOREIGN PATENT DOCUMENTS

| | | | |
|---|---|---|---|
| 0166544 | 1/1986 | European Pat. Off. | 355/259 |
| 0067961 | 4/1982 | Japan | 355/251 |

*Primary Examiner*—Fred L. Braun
*Assistant Examiner*—William J. Royer
*Attorney, Agent, or Firm*—H. Fleischer; J. E. Beck; R. Zibelli

[57] ABSTRACT

An apparatus which develops a latent image recorded on a photoconductive member in an electrophotographic printing machine. The apparatus includes a housing having a chamber storing a supply of developer material, a magnetic transport roll, a donor roll and a developer roll magnetic. The developer material includes carrier and toner. The magnetic transport roll delivers developer material to the magnetic developer roll and toner to the donor roll. Toner is delivered from the magnetic developer roll and donor roll to the photoconductive member to develop the latent image.

3 Claims, 2 Drawing Sheets

Figure 1:
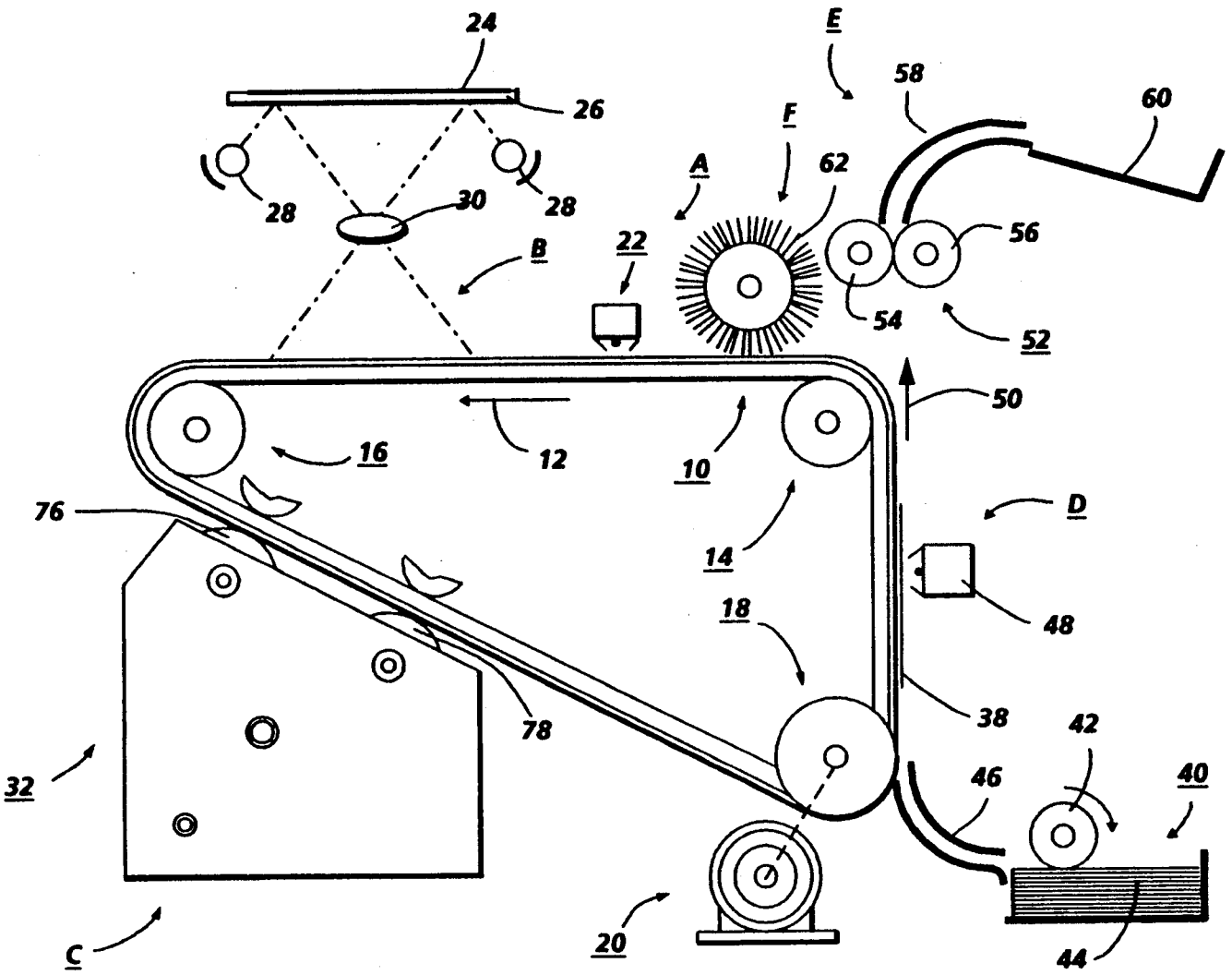

MAGNETIC TRANSPORT ROLL FOR SUPPLYING TONER OR CARRIER AND TONER TO A DONOR AND MAGNETIC DEVELOPER ROLL RESPECTIVELY

This invention relates generally to an electrophotographic printing machine, and more particularly relates to an apparatus for developing a latent image recorded on a photoconductive member in a printing machine.

Generally, the process of electrophotographic, printing includes the step of charging a photoconductive member to a substantially uniform potential to sensitize the surface thereof. The charged portion of the photoconductive surface is exposed to a light image of an original document being reproduced. This records an electrostatic latent image on the photoconductive member corresponding to the original document. The recorded latent image is then developed by bringing a developer material into contact therewith. This forms a toner powder image on the photoconductive member which is subsequently transferred to a copy sheet. Finally, the powder image is heated to permanently affix it to the copy sheet in image configuration.

A suitable developer material may be a two-component mixture of carrier granules having toner particles adhering triboelectrically thereto. The toner particles are attracted to, and adhere to, the electrostatic latent image to form a powder image on the photoconductive surface. Single component developers are also known: they have only toner particles, the particles having an electrostatic charge (for example, a triboelectric charge) so that they will be attracted to, and adhere to, the latent image on the photoconductive surface. Studies of single component development have demonstrated that this process can produce nearly lithographic quality low density, noise free solid area. Two component development systems are well known for generating excellent line quality, good halftones and good high density solid areas, but do not generate adequate midtone solid areas. Thus, two component and single component development each have unique development capabilities. Single component does excellent midtone solids while two component does well at fine detail line art.

There are various known forms of development systems for bringing toner particles to a latent image on a photoconductive surface. One form includes a magnetic brush roll which picks up developer from a reservoir through magnetic attraction and carries the developer into proximity with the latent image. In a modification of the magnetic brush apparatus, the magnetic brush roll does not bring toner directly to the photoconductive surface but transfers toner to a donor roll which then carries the toner into proximity with the latent image. In single component scavengeless development, a donor roll is used with a plurality of electrode wires closely spaced therefrom in the development zone. An AC voltage is applied to the wires to form a toner cloud in the development zone and the electrostatic fields generated by the latent image attract toner from the cloud to develop the latent image. In single component jumping development, an AC voltage is applied to the donor roll, causing toner to be detached from the roll and projected towards the photoconductive surface. The toner is attracted by the electrostatic fields generated by the latent image and the latent image is developed.

A development system using a magnetic roll and a donor roll was described by Toshiba at the 2nd International Congress on Advances in Non-impact Printing held in Washington, D.C. on Nov. 4–8, 1984, sponsored by the Society for Photographic Scientists and Engineers. The donor roll and magnetic roll were electrically biased and the magnetic roll transported a two component developer material to the nip defined by the two rolls where toner was attracted to the donor roll from the magnetic roll. The donor roll rotated synchronously with the photoconductive drum with the gap therebetween being about 0.20 millimeters. The large difference in potential between the donor roll and latent image recorded on the photoconductive drum caused the toner to jump across the gap from the donor roll to the latent image so as to develop the latent image. Various other types of development systems have been devised. The following disclosures appear to be relevant:

U.S. Pat. No. 4,008,686, Patentee: Katakura et al., Issued: Feb. 22, 1977

U.S. Pat. No. 4,266,868, Patentee: Bresina et al., Issued: May 12, 1981

U.S. Pat. No. 4,384,545, Patentee: Burnham et al., Issued: May 24, 1983

U.S. Pat. No. 4,436,055, Patentee: Yamashita et al., Issued: Mar. 13, 1984

U.S. Pat. No. 4,466,728, Patentee: Schlageter et al., Issued: Aug. 21, 1984

U.S. Pat. No. 4,545,669, Patentee: Hays et al., Issued: Oct. 8, 1985

U.S. Pat. No. 4,565,437, Patentee: Lubinsky, Issued: Jan. 21, 1986

U.S. Pat. No. 4,572,647, Patentee: Bean et al., Issued: Feb. 25, 1986

U.S. Pat. No. 4,833,504, Patentee: Parker et al., Issued: May 23, 1989

U.S. Pat. No. 4,847,655, Patentee: Parker et al., Issued: July 11, 1989

U.S. Pat. No. 4,868,600, Patentee: Hays et al., Issued: Sept. 19, 1989

Co-pending U.S. patent application Ser. No. 07/429,108, Applicant: Folkins, Filing Date: Oct. 30, 1989.

The relevant portions of the foregoing disclosures may be briefly summarized as follows:

U.S. Pat. No. 4,008,686 discloses a developing apparatus for use in an electrophotographic printing machine having a toner chamber and a pair of magnetic rolls for moving developer material to a photoconductive drum.

U.S. Pat. No. 4,266,868 describes a pair of developer rolls each having a magnetic inner shaft and a non-magnetic outer sleeve.

U.S. Pat. No. 4,384,545 discloses a pair of developer rolls for transporting developer material into contact with a photoconductive surface. One of the developer rolls has a magnetic shaft and a nonmagnetic, insulating, sleeve. The other developer roll has a magnetic shaft and a non-magnetic, conductive, sleeve.

U.S. Pat. No. 4,436,055 describes a conveying roll having a nonmagnetic sleeve and a magnetic shaft. The conveying roll transports developer material to a first developer roll which, in turn, transports developer material to a second developer roll forming a blanket adjacent a photoconductive drum. Both of the developer roll have a nonmagnetic sleeve and a magnetic shaft.

U.S. Pat. No. 4,466,728 describes a developer station having a transport roll for advancing developer material to a developer roll. After development, a collecting roll removes carrier adhering to the photoconductive drum.

U.S. Pat. No. 4,545,669 discloses a developer unit in which a paddle wheel advances conductive developer material to a sensitizing roll to tone an imaging member. The imaging member having the toner image is selectively illuminated and toner particles are scavenged from the nonimage or dark areas by a development roll.

U.S. Pat. No. 4,565,437 describes a development system in which a portion of a photoconductive belt is wrapped about a portion of a first developer roll and spaced from a second developer roll. The first developer roll optimizes solid area development and the second developer roll optimizes line development.

U.S. Pat. No. 4,572,647 discloses a development system having a pair of developer rolls. One developer rolls develops the latent image with charged insulating marking particles to optimize development of low density lines. The other developer roll develops the same latent image with polar or polarizable marking particles to optimize development of halftones.

U.S. Pat. No. 4,833,504 and U.S. Pat. No. 4,847,655 describe highlight color printers which include a plurality of developer housings. Each developer housing has a plurality of developer rolls.

U.S. Pat. No. 4,868,600 discloses a development system having a donor roll and electrode wires. The electrode wires are positioned closely adjacent to the donor roll in the development zone between the photoconductive belt and the donor roll. An AC electrical bias is applied to the electrode wires to detach toner from the donor roll forming a toner powder cloud in the development zone which develops the latent image.

Co-pending U.S. patent application Ser. No. 07/429,108 discloses a pair of donor rolls and a magnetic transport roll. Electrode wires are positioned closely adjacent each of the developer rolls in the development zone between the photoconductive belt and the donor rolls. The magnetic transport delivers developer material adjacent to each of the donor rolls. The donor rolls attract toner thereto and advance the toner to the development zones. Excitation of the electrodes detaches the toner from the donor rolls forming a toner powder cloud in the development zones. The detached toner develops the latent image.

In accordance with one aspect of the invention, there is provided an apparatus for developing a latent image recorded on a surface. The apparatus includes a housing defining a chamber adapted to store a supply of developer material comprising at least carrier and toner therein. A donor member is positioned at least partially in the chamber of the housing. The donor member is adapted to deliver toner to the surface to develop the latent image recorded thereon with toner. A developer member, spaced from the donor member, is positioned at least partially in the chamber of the housing. The developer member is adapted to deliver developer material to the surface to develop the latent image recorded thereon with toner. A common transport member, positioned in the chamber of the housing, is arranged to transport developer material to supply developer material therefrom to the developer member and to supply toner therefrom to the donor member.

Pursuant to another aspect of the present invention, there is provided an electrophotographic printing machine of the type having an electrostatic latent image recorded on a photoconductive surface developed by toner to form a visible image thereof. The improvement includes a housing defining a chamber adapted to store a supply of developer material comprising at least carrier and toner therein. A donor member is positioned at least partially in the chamber of the housing. The donor member is adapted to deliver toner to the surface to develop the latent image recorded thereon with toner. A developer member, spaced from the donor member, is positioned at least partially in the chamber of the housing. The developer member is adapted to deliver developer material to the surface to develop the latent image recorded thereon with toner. A common transport member, positioned in the chamber of the housing, is arranged to transport developer material to supply developer material therefrom to the developer member and to supply toner therefrom to the donor member.

Figure 2:
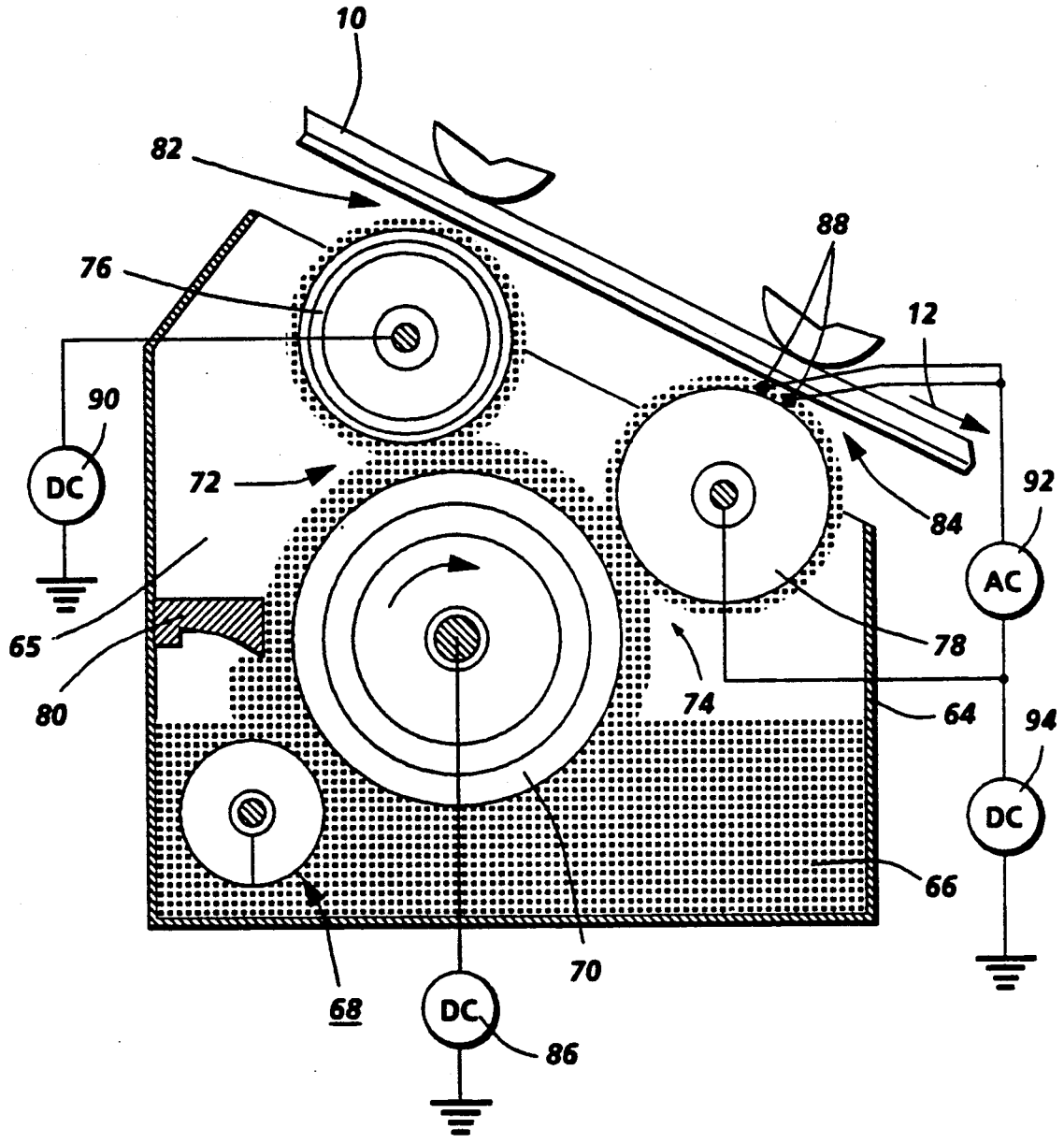

Other features of the present invention will become apparent as the following description proceeds and upon reference to the drawings, in which:

FIG. 1 is a schematic elevational view depicting an illustrative electrophotographic printing machine incorporating the development apparatus of the present invention therein; and FIG. 2 is a schematic elevational view showing the development apparatus of the FIG. 1 printing machine in greater detail.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

In the drawings, like reference numerals have been used throughout to designate identical elements. FIG. 1 schematically depicts the various components of an illustrative electrophotographic printing machine incorporating the development apparatus of the present invention. It will become evident from the following discussion that this development apparatus is equally well suited for use in a wide variety of electrostatographic printing machines and for use in ionographic printing machines.

Inasmuch as the art of electrophotographic printing is well known, the various processing stations employed in the FIG. 1 printing machine will be shown hereinafter schematically and their operation described briefly with reference thereto.

The printing machine shown in FIG. 1 employs a photoconductive belt 10 of any suitable type, which moves in the direction of arrow 12 to advance successive portions of the photoconductive surface of the belt through the various stations disposed about the path of movement thereof. As shown, belt 10 is entrained about rollers 14 and 16 which are mounted to be freely rotatable and drive roller 18 which is rotated by a motor 20 to advance the belt in the direction of the arrow 12.

Initially, a portion of belt 10 passes through a charging station A. At charging station A, a corona generating device, indicated generally by the reference numeral 22, charges a portion of the photoconductive surface of belt 10 to a relatively high, substantially uniform potential.

Next, the charged portion of the photoconductive surface is advanced through an exposure station B. At exposure station B, an original document 24 is positioned face down upon a transparent platen 26. Lamps 28 flash light onto the document 24 and the light that is reflected is transmitted through lens 30 forming a light image on the charged portion of the photoconductive surface. The charge on the photoconductive surface is selectively dissipated, leaving an electrostatic latent image on the photoconductive surface which corresponds to the original document 24 disposed upon transparent platen 26. The belt 10 then advances the electrostatic latent image to a development station C.

At development station C, a development apparatus indicated generally by the reference numeral 32, develops the electrostatic latent image recorded on the photoconductive surface with toner particles. Development apparatus 32 includes a magnetic developer roller 76 and a donor roller 78 for delivering toner particles to the latent image recorded on photoconductive belt 10 to form a toner powder image thereon. The toner powder image is advanced to transfer station D. Development apparatus 32 will be described hereinafter in greater detail with reference to FIG. 2.

At transfer station D, a sheet of support material 38 is moved into contact with the toner powder image. Support material 38 is advanced to transfer station D by a sheet feeding apparatus, indicated generally by the reference numeral 40. Preferably, sheet feeding apparatus 40 includes a feed roll 42 contacting the uppermost sheet of a stack of sheets 44. Feed roll 42 rotates to advance the uppermost sheet from stack 44 into chute 46. Chute 46 directs the advancing sheet of support material 38 into contact with the photoconductive surface of belt 10 in a timed sequence so that the toner powder image developed thereon contacts the advancing sheet of support material at transfer station D.

Transfer station D includes a corona generating device 48 which sprays onto the back side of sheet 38. This attracts the toner powder image from the photoconductive surface to sheet 38. After transfer, the sheet continues to move in the direction of arrow 50 into a conveyor (not shown) which advances the sheet to fusing station E.

Fusing station E includes a fusing assembly, indicated generally by the reference numeral 52, which permanently affixes the transferred powder image to sheet 38. Preferably, fuser assembly 52 includes a heated fuser roller 54 and back-up roller 56. Sheet 38 passes between fuser roller 54 and back-up roller 56 with the toner powder image contacting fuser roller 54. In this way, the toner powder image is permanently affixed to sheet 38. After fusing, chute 58 guides the advancing sheet to catch tray 60 for subsequent removal from the printing machine by the operator.

Invariably, after the sheet of support material is separated from the photoconductive surface of belt 10, some residual toner particles remain adhering thereto. These residual particles are removed from the photoconductive surface at cleaning station F. Cleaning station F includes a pre-clean corona generating device (not shown) and a rotatably mounted fibrous brush 62 in contact with the photoconductive surface of belt 10. The pre-clean corona generating device neutralizes the charge attracting the particles to the photoconductive surface. These particles are cleaned from the photoconductive surface by the rotation of brush 62 in contact therewith. Subsequent to cleaning, a discharge lamp (not shown) floods the photoconductive surface with light to dissipate any residual charge remaining thereon prior to the charging thereof for the next successive imaging cycle.

Referring now to FIG. 2, there are shown the details of the development apparatus 32. The apparatus comprises a housing 64 having a chamber 65 containing developer material 66 therein. The developer material 66 is of the two component type, that is it comprises magnetic carrier granules having toner particles adhering triboelectrically thereto. The reservoir includes augers, indicated at 68, which are rotatably mounted in the reservoir chamber. The augers 68 serve to transport and to agitate the material within the chamber and encourage the toner particles to adhere triboelectrically to the carrier granules. A magnetic transport roll 70 transports developer material in the chamber to the loading nips 72, 74 of magnetic developer roll 76 and donor roll 78, respectively. Magnetic rolls are well known, so the construction of developer roll 76 and transport roll 70 need not be described in great detail. Briefly each roll comprises a rotatable tubular sleeve within which is located a stationary magnetic cylinder having a plurality of magnetic poles impressed around its surface. The carrier granules of the developer material are magnetic and, as the tubular sleeve of the roll 70 rotates, the granules (with toner particles adhering triboelectrically thereto) are attracted to the roll 70 and are conveyed to the loading nip 72. Metering blade 80 removes excess developer material from the magnetic brush roll and insures an even depth of coverage with developer material before arrival at loading nip 72. At loading nip 72, developer material is attracted from magnetic transport roll 70 to magnetic developer roll 76. In order to attract the developer material from magnetic transport roll 70 to magnetic developer roll 76, the intensity of the magnetic field in loading nip 72 is set so that a portion of the developer material adhering to magnetic transport roll 70 is transferred to magnetic developer roll 76. After a portion of the developer material is transferred from magnetic transport roll 70 to magnetic developer roll 76 at loading nip 72, the remaining developer material is transported by transport roll 70 to loading nip 74. At loading nip 74, toner particles are transferred from the magnetic transport roll 70 to donor roll 78. Transfer of toner from the transport roll 70 to donor roll 78 can be encouraged by, for example, the application of a suitable DC electrical bias between magnetic transport roll 70 and donor roll 78. A DC bias supply 86 applies approximately 100 volts to magnetic transport roll 70. Alternatively, transport roll 70 can be at electrical ground. A DC bias supply 90 applies a selected voltage ranging from between about 150 volts to about 250 volts to magnetic developer roll 76. Another DC bias supply 94 applies about 300 volts to donor roll 78. The electrostatic field between the transport roll 70 and the donor roll 78 causes toner particles to be attracted to donor roll 78 from the carrier granules on the magnetic transport roll 70. The carrier granules and any toner particles that remain on the magnetic transport roll 70 after passing through loading nip 74 are returned to chamber 65 as the magnetic transport roll 70 continues to rotate. Magnetic developer roll 76 transports developer material to development zone 82. Photoconductive belt 10 passes through development zones 82 and 84 sequentially. DC bias supply 90 establishes an electrical field between the photoconductive surface of belt 10 and the magnetic developer roll 76 to attract toner particles from the developer material adhering to developer roll 76 at development zone 82 to the latent image recorded on the photoconductive surface of belt 10. An alternating electrical bias is applied to the electrode wires 88 in development zone 84 by an AC voltage source 92. The applied AC voltage establishes an alternating electric field between the electrode wires 88 and the surface of the donor roll 78 which is effective in detaching toner particles from the surface of the donor roll 78 to form a toner powder cloud about the electrode wires 88. The height of the toner powder cloud above electrode wires 88 is such that it is not in substantial contact with the surface of belt 10. The magnitude of the AC voltage is relatively low and ranges from about 200 volts peak to about 500 volts peak at a frequency ranging from about 2 KHZ to about 10 KHZ. At a spacing ranging from about 10μ to about 40μ between the donor roll 78 and wires 88, the AC bias produces a relatively large peak electric field without risk of air breakdown. The use of a dielectric or electrically relaxable coating on either the electrode wires 88 or the donor roll 78 helps to prevent air breakdown or shorting of the applied AC voltage. The DC bias supply 94 establishes an electrostatic field between the photoconductive surface of belt 10 and the donor roll 78 for attracting the detached toner particles from the cloud surrounding the wires to the latent image recorded on the photoconductive surface of belt 10. The spacing between the surface of the donor roll 78 and the photoconductive surface of belt 10 ranges from about 0.006 inches (0.015 centimeters) to about 0.020 inches (0.050 centimeters).

The relative amounts of developer material transferred from the magnetic transport roll 70 to the magnetic developer roll 76, and toner transferred to donor roll 78 can be adjusted, for example by applying different bias voltages between the magnetic transport roll and the donor roll, adjusting the spacing between the rolls in the loading nip, adjusting the strength and shape of the magnetic field at the loading nips and/or adjusting the speeds of the rolls.

At each of the development zones 82, 84, toner is transferred from the magnetic developer roll 76 and donor roll 78, respectively, to the latent image on the belt 10 to form a toner powder image on the latter. Donor roll 78 has a pair of electrode wires 88 extending in a direction substantially parallel to the longitudinal axis of the donor roll. The electrode wires are made from thin (i.e. 50 to 100μ diameter) tungsten wires which are closely spaced from the respective donor roll. The distance between each wire and the donor roll is within the range of from about 10μ to about 40μ (typically approximately 25μ) or the thickness of the toner layer on the donor roll. The wires are self-spaced from the donor rolls by the thickness of the toner on the donor rolls. To this end the extremities of the wires are supported by the tops of end bearing blocks that also support the donor rolls for rotation. The wire extremities are attached so that they are slightly below a tangent to the surface, including the toner layer, of the donor roll structure.

After development, toner may be stripped from the donor roll and developer roll by respective cleaning blades (not shown) so that transport roll 70 meters fresh developer material to developer roll 76 and fresh toner to donor roll 78. As successive electrostatic latent images are developed, the toner particles within the developer material 66 are depleted. A toner dispenser (not shown) stores a supply of toner particles. The toner dispenser is in communication with chamber 65 and, as the concentration of toner particles in the developer material is decreased, fresh toner particles are furnished to the developer material in the chamber. The augers 68 in the chamber mix the fresh toner particles with the remaining developer material so that the resultant developer material therein is substantially uniform with the concentration of toner particles being optimized. In this way, a substantially constant amount of toner particles is in the reservoir with the toner particles having a constant charge.

In the arrangement shown in FIG. 2, developer roll 76, donor roll 78 and transport roll 70 can be rotated either "with" or "against" the direction of motion of the belt 10.

The two-component developer 66 used in the apparatus of FIG. 2 may be of any suitable type. By way of example, the carrier granules of the developer material may include a ferromagnetic core having a thin layer of magnetite overcoated with a non-continous layer of resinous material. The toner particles may be made from a resinous material, such as a vinyl polymer, mixed with a coloring material, such as chromogen black. The developer material may comprise from about 95% to about 99% by weight of carrier and from 5% to about 1% by weight of toner.

It is clear that the development system heretofore described sequentially develops the latent image with a two component development roll and a single component development roll in a single housing. This results in the excellent solid area and line copy characteristics of two component techniques and generates low noise midtone solid areas and half tone characteristic of non-contact single component development techniques.

In recapitulation, the development apparatus of the present invention includes a magnetic transport roll which advances developer material to a magnetic developer roll and a donor roll. A portion of the developer material is delivered to the developer roll from the transport roll at a loading nip. Toner is delivered from the remaining developer material on the transport roll to the donor roll at another loading nip. Electrode wires adjacent the donor roll are excited to form a toner powder cloud in the development zone. Toner is attracted from the developer material on the developer roll and from the toner powder cloud to the latent image. In this way, the latent image is developed to form a toner powder image on the photoconductive belt.

It is, therefore, apparent that there has been provided in accordance with the present invention, an apparatus for developing a latent image that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An electrophotographic printing machine of the type having an electrostatic latent image recorded on a photoconductive surface developed by toner to form a visible image thereof, wherein the improvement includes:

a housing defining a chamber adapted to store a supply of developer material comprising at least carrier and toner therein;

a donor roll positioned at least partially in the chamber of said housing, said donor roll being adapted to deliver toner to the surface to develop the latent image recorded thereon with toner;

a magnetic developer roll spaced from said donor roll and positioned at least partially in the chamber of said housing, said developer roll being adapted to deliver developer material to the surface to develop the latent image recorded thereon with toner;

a magnetic transport roll adapted to transport developer material to a first loading zone where a portion of the developer material is attracted to said magnetic developer roll with the remainder of the developer material being transported to a second loading zone where toner is attracted from carrier to said donor roll, and an electrode member positioned in the space between the surface and said donor roll, said electrode member being closely spaced from said donor roll and being electrically biased to detach toner from said donor roll so as to form a toner cloud in the space between said electrode member and the surface with detached toner from the toner cloud developing the latent image.

2. A printing machine according to claim 1, further including means for electrically biasing said donor roll and said magnetic transport roll relative to one another so as to deposit toner on said donor roll.

3. A printing machine according to claim 2, wherein said magnetic developer roll attracts magnetically developer material from said magnetic transport roll.

* * * * *